US005402980A

United States Patent [19]

Gray et al.

[11] Patent Number: 5,402,980

[45] Date of Patent: Apr. 4, 1995

[54] WOUND PAPER ROLL SUPPORT APPARATUS

[75] Inventors: Warren R. Gray; Joseph T. Walsh, both of St. Cloud, Minn.

[73] Assignee: Champion International Corporation, Stamford, Conn.

[21] Appl. No.: 231,366

[22] Filed: Apr. 19, 1994

Related U.S. Application Data

[63] Continuation of Ser. No. 168,921, Dec. 16, 1993, abandoned, which is a continuation of Ser. No. 920,873, Jul. 28, 1992, abandoned.

[51] Int. Cl.[6] ..... F16M 13/00

[52] U.S. Cl. ..... 248/631; 248/562

[58] Field of Search ..... 248/562, 631, 636; 267/35, 152

[56] References Cited

U.S. PATENT DOCUMENTS

| | | | |
|---|---|---|---|
| 3,589,655 | 6/1971 | Hackbarth | 248/631 |
| 4,790,520 | 12/1988 | Tanaka et al. | 267/152 |
| 5,080,331 | 1/1992 | de Fontenay | 248/636 X |

*Primary Examiner*—Kenneth E. Peterson

[57] ABSTRACT

A wound paper roll support including an air inflatable rubber bladder on a planar table support. The inflated tube will support and conform to variables in the length and diameter of each roll which is supported by the table after removal from a winding apparatus positioned adjacent to the table.

6 Claims, 1 Drawing Sheet

WOUND PAPER ROLL SUPPORT APPARATUS

This application is a continuation of application Ser. No. 08/168,921, filed Dec. 16, 1993, now abandoned, which in turn is a continuation of Ser. No. 07/920,873, filed Jul. 28, 1992, now abandoned.

BACKGROUND OF THE INVENTION

1. Field of the Invention

This invention relates to a support surface, and more particularly, to an inflatable and deformable support surface for a plurality of wound paper rolls adapted to conform to dimensional variations in the rolls to provide uniform support for the rolls during their removal from the winding apparatus.

2. Description of the Prior Art

Paper, after being manufactured, is wound in a roll formed between a pair of spaced chucks. The rolls may be of various diameters and widths. Due to dimensional variations, particularly in diameters, some means is necessary to uniformly support the rolls during the unchucking process and prior to further handling and processing.

Heretofore, it was common to support the rolls on a table during the unchucking process. The table was provided with sections which were raised independently to support all the wound paper rolls evenly during the unchucking process, regardless of length and diameter. The rolls, after unchucking, were then removed or off-loaded from the table support by uniform handling apparatus.

Often, the rolls were not evenly supported and would become stuck in their chucks if of a diameter larger than the distance from the chuck to the table or roll freely off the table, creating a safety and production problem during the off-loading procedure, if not of a sufficient diameter to contact the table when dropped from the chucks. This was caused because the table support was rigid and unforgiving. Variations in the wound roll diameter of individual rolls were in no way compensated for along with variations in the length of the roll. The table was also formed from nonfriction generating material which could serve as an aid in gripping and steadying the roll.

SUMMARY OF THE INVENTION

In accordance with the present invention, an air inflatable rubber bladder is provided on a planar table support beneath the wound paper rolls. Prior to unchucking of the rolls, the tube is inflated. During the unchucking process, the inflated tube will support and conform to variables in the length and diameter of each roll, making up for any dimensional differences from roll to roll, providing uniform support during the unchucking process and, because the bladder is rubber, will aid in frictionally holding the unchucked roll on the table support. After the unchucking process is completed, the bladder deflates rapidly as the table returns to the unloading position so that the finished rolls can safely roll over the support bladder, out of the chucks and winder into a suitable collection apparatus.

BRIEF DESCRIPTION OF THE DRAWINGS

Further objects and advantages of the invention will become more apparent from the following description and claims, and from the accompanying drawing, wherein:

DETAILED DESCRIPTION OF THE PREFERRED EMBODIMENT

Figure 1:
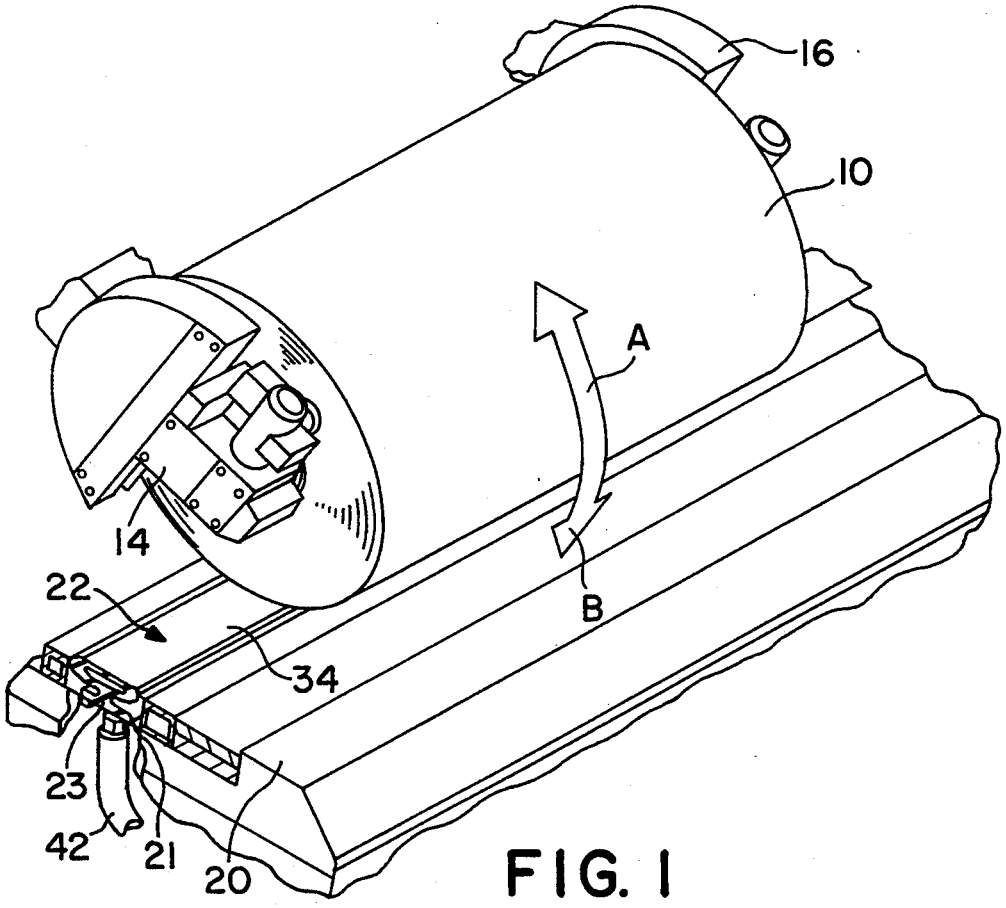
FIG. 1 is a perspective view of a wound paper roll being off-loaded from paper winding chucks onto the support of the present invention shown partially in section.

Referring now to the drawing in detail wherein like numerals indicate like elements throughout the several views, a plurality of paper rolls 10, after manufacture of the paper, are formed between a pair of spaced chucks 14,16 by winding the paper on a core (not shown) supported between each pair of chucks.

After winding, each of the paper rolls 10 on its core is removed from the chucks 14,16 by, for example, swinging the chucks laterally relative to the rolls 10. The rolls will drop onto a substantially planar support surface 20 provided with an inset consisting of an inflatable and deformable bladder 22 formed from rubber or the like, supported in a channel 21 in planar support surface 20.

Figure 2:
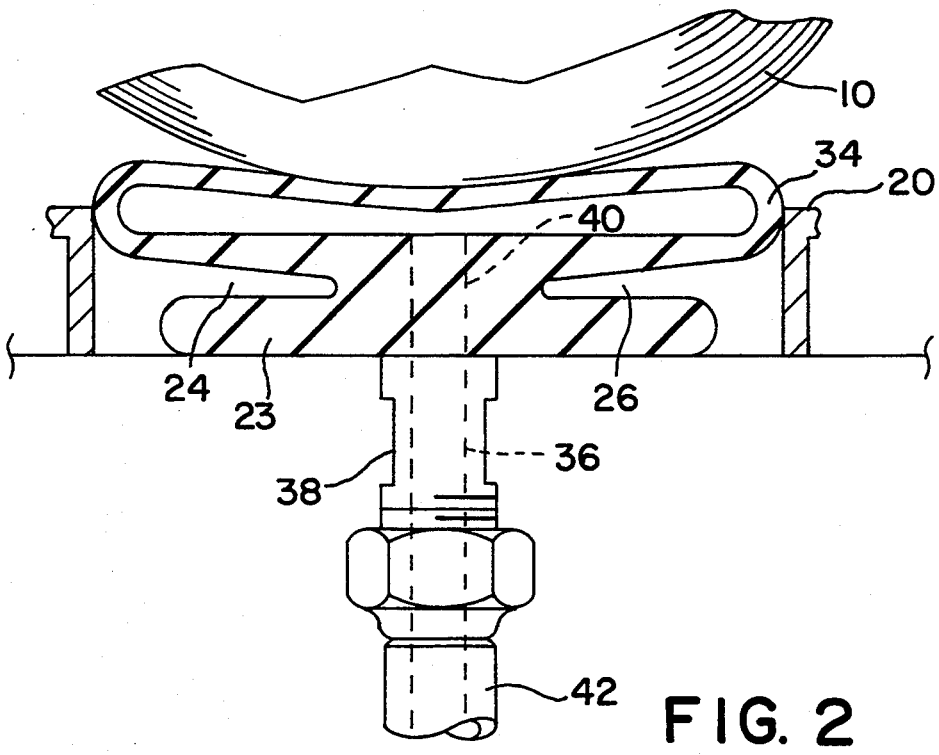
FIG. 2 is an enlarged cross-sectional view of the support of FIG. 1 in its inflated condition.

As shown specifically in FIG. 2, the bladder 22 is provided with a substantially solid foot portion or pedestal 23 having opposed longitudinally extending grooves 24,26 enabling the pedestal 23 to forgivingly support an inflatable and distensible hollow tube or head portion 34 extending upwardly from foot portion 23 above planar surface 20. The interior of head or tube portion 34 is in communication with the bore 36 of threaded tire valve nipple 38 closed by a one-way valve (not shown) through a bore 40 in foot portion 23.

Prior to unchucking of rolls 10, the tube or head portion 34 of bladder 22 is inflated by connecting a source of compressed air 42 to nipple 38 and admitting air through its valve and bore 36 into bore 40 of pedestal 23 and then to the interior of tube 34. The tube will be extended above planar support surface 20 beneath rolls 10.

During the unchucking process, the inflated tube or head 34 will support, distend, cushion and conform to variables in the length and diameter of each roll 10, making up for any dimensional differences from roll to roll, providing uniform support during the unchucking process and preventing the rolls 10 from rolling around their axes in the directions indicated by arrow A of FIG. 1. After the unchucking process is completed, head 34 can be deflated rapidly as the table returns to the unloading position so that the finished rolls 10 can roll over the support bladder 22, out of the chucks 14,16 and winder in the direction of arrowhead B of arrow A for collection and further handling.

What is claimed is:

1. Wound paper roll support apparatus for supporting a plurality of paper rolls after winding and during offloading from a winder, comprising:

a substantially planar support surface;

an inflatable tube on said support surface said tube having an upper surface adapted to support, distend, cushion and conform to a paper roll placed on said upper surface after winding and during offloading of said roll from said winder said tube further being adapted to be inflated to an inflated position to extend above said planar support surface beneath said paper rolls during the removal of said rolls from said winder and deflated to a deflated position below said inflated position after removal of said paper rolls from said winder whereby said roll can roll over or off said upper surface of said tube; and valve means projecting from said inflatable tube for admitting air to the interior of said tube and for discharging air to the exterior of said tube.

2. The support apparatus of claim 1 wherein said inflatable tube is connected to a foot support portion provided with a bore therethrough in communication with the interior of said tube, said foot support portion being connected to said valve means with its bore in communication with said valve means.

3. The support apparatus of claim 2 wherein said foot support portion is spaced from said tube portion by a pair of opposed longitudinally extending grooves along the intersection of said tube portion and said foot support portion.

4. The support apparatus of claim 3 wherein said inflatable tube is formed from friction-generating material.

5. The support apparatus of claim 4 wherein said friction-generating material is rubber.

6. Wound paper roll support apparatus for supporting a plurality of paper rolls after winding and during offloading from a winder, consisting essentially of:

a substantially planar support surface;

an inflatable tube on said support surface said tube having an upper surface adapted to support, distend, cushion and conform to a paper roll placed on said upper surface after winding and during offloading of said roll from said winder said tube further being adapted to be inflated to an inflated position to extend above said planar support surface beneath said paper rolls during the removal of said rolls from said winder and deflated to a deflated position below said inflated position after removal of said paper rolls from said winder whereby said roll can roll over or off said upper surface of said tube; and valve means projecting from said inflatable tube for admitting air to the interior of said tube and for discharging air to the exterior of said tube.

* * * * *